US005472307A

United States Patent [19]

Kadlec et al.

[11] Patent Number: 5,472,307

[45] Date of Patent: Dec. 5, 1995

[54] WHEELCHAIR TILT LIFT

[75] Inventors: Anthony J. Kadlec, 481 Bartlett Ave., Altoona, Wis. 54720; Keith E. Granberg, Mondove, Wis.; William J. Feirn, New Auburn, Wis.; Jerald J. Olson, Eau Claire, Wis.; Jonathan A. Kadlec, Altoona, Wis.

[73] Assignee: Anthony J. Kadlec, Altoona, Wis.

[21] Appl. No.: 303,616

[22] Filed: Sep. 9, 1994

[51] Int. Cl.[6] ..... A61G 7/14

[52] U.S. Cl. ..... 414/678; 414/921; 297/344.13; 297/DIG. 10

[58] Field of Search ..... 414/678, 728, 414/742, 744.4, 921; 297/344.13, 344.21, DIG. 10; 410/30, 49; 188/32

[56] References Cited

U.S. PATENT DOCUMENTS

| | | | |
|---|---|---|---|
| 1,936,107 | 11/1933 | Cunneen | 188/32 |
| 3,280,462 | 10/1966 | Deeley, Jr. | 297/344.13 |
| 3,476,404 | 11/1969 | Rachman | 414/678 |
| 3,638,813 | 2/1972 | Strong | 414/742 |
| 4,192,549 | 3/1980 | Petersen | 297/464 |
| 4,527,944 | 7/1985 | Qually et al. | 414/678 |
| 4,561,823 | 12/1985 | Norton | 414/678 |
| 4,592,695 | 6/1986 | McConnell | 414/678 |
| 4,726,730 | 2/1988 | McConnell | 414/678 |
| 4,759,684 | 7/1988 | Lanzillotta et al. | 414/678 |
| 4,790,716 | 12/1988 | McConnell | 414/678 |
| 4,821,347 | 4/1989 | Nash | 4/516 |
| 4,834,411 | 5/1989 | Willey et al. | 280/250 |
| 4,941,799 | 7/1990 | Gordon et al. | 414/678 |
| 5,007,118 | 4/1991 | Ebersole | 4/515 |
| 5,040,939 | 8/1991 | Booth | 414/678 |
| 5,144,701 | 8/1992 | Clark | 4/515 |

FOREIGN PATENT DOCUMENTS

| | | | |
|---|---|---|---|
| 2406435 | 5/1979 | France | 297/344.13 |

*Primary Examiner*—Michael S. Huppert
*Assistant Examiner*—Douglas A. Hess
*Attorney, Agent, or Firm*—Lathrop & Clark

[57] ABSTRACT

To provide convenient positioning of a subject in a wheelchair, the apparatus has a wheelchair support bucket with two wheel tubs which are connected by an axle. The wheelchair is pivotable in the bucket about the axle for tilting of the occupant. The axle is mounted to a frame which is elevatable on bearings, and the frame runs horizontally on tracks, and is rotatable. The bucket tubs have semi-cylindrical surfaces which position the wheelchair with the wheelchair brace frontward of the housing. The movement mechanism is thus able to be compactly positioned with respect the wheelchair, for convenient positioning of subjects for hair care, dentistry, or other operations. Tilt locks are provided on each bucket tub to passively prevent the egress of a wheelchair from an elevated or tilted bucket.

15 Claims, 5 Drawing Sheets

WHEELCHAIR TILT LIFT

FIELD OF THE INVENTION

The present invention relates to apparatus for accommodating those in wheelchairs in general, and in particular to apparatus for positioning a person within a wheelchair for bodily care.

BACKGROUND OF THE INVENTION

Many people, for reason of illness, age, or disability, rely on wheelchairs for mobility, either as a temporary measure, or on a permanent basis. Increased use of ramps and elevators in public and private buildings, however, as well as an attention by facility planners to the needs of those who must remain in a seated position, has resulted in improved access to many services formerly denied to those in wheelchairs. Such advances have demonstrated that a person need not sacrifice independence or everyday amenities simply because of reliance on a wheelchair.

The barber shop and the beautician's continue to present special problems for those in wheelchairs. Although these hair care facilities are ordinarily provided with specialized position-control chairs for presenting the subject's head at an appropriate level for work by the barber or beauty operator, transferring a subject from a wheel chair may require strong lifting assistance from the operator, and may prove hazardous to a subject whose muscular control is impaired. Many facilities attend to the needs of those in wheelchairs by providing a pair of orderlies or assistants who manually grip the wheelchair and lift and tilt it as required to position the subject's head over a wall mounted sink. Such an operation presents the danger of back strain to the people doing the lifting and, because of the potential unsteadiness, may be disturbing or unsettling to the person so lifted.

A number of automated wheelchair lifts and tilt-adjust platforms have been developed to address this need. However, prior art lifts have suffered from a number of serious deficiencies. Many such devices are capable only of tilting the wheelchair about a fixed axis, or of tilting and elevating only. These motions will not always be sufficient to position a subject's head over a sink or other treating apparatus, due to the great variation in height and posture of subjects. Although some subjects may be able to raise or lower their heads with respect to the chairs, to do so for an extended period of time may induce fatigue or strain.

Furthermore, many prior art units are obtrusively bulky, occupying valuable floor space in the facility which might better be utilized. In addition, some lift units may present a sensation of uneasiness or risk which is not conducive to a satisfactory treatment experience.

What is needed is a wheelchair lift which safely and comfortably positions subjects of varying heights in proper position for hair care and other head-related procedures.

SUMMARY OF THE INVENTION

The wheelchair tilt lift of this invention provides safe and convenient positioning of persons within wheelchairs, especially for personal care procedures such as hair care or dentistry. The lift has a rotation bearing which is mounted to a support surface. A housing is mounted to tracks on the rotation bearing for transverse motion. A frame is mounted within the housing for vertical motion with respect to the housing. A wheelchair support bucket has two wheel tubs which are connected by an axle and mounted to the frame for pivotable motion. Actuators are connected to the frame, the housing, and the bucket which are controllable by an operator to position a person in a wheelchair both horizontally, vertically, and at a desired inclination to position the head of a person in a wheelchair at the proper position for operation thereon. The bucket tubs have semi-cylindrical surfaces which position the wheelchair with the wheelchair brace frontward of the housing. The movement mechanism is thus able to be compactly positioned with respect the wheelchair. Tilt locks are provided on each bucket tub to passively prevent the egress of a wheelchair from an elevated or tilted bucket.

It is an object of the present invention to provide a wheelchair lift which is compact for tilt positioning of subjects with respect to fixed apparatus such as a wail mounted sink.

It is another object of the present invention to provide a wheelchair lift which has passive safety locks to prevent egress from the lift in an elevated or tilted position.

It is also an object of the present invention to provide a wheelchair lift which positions a subject of limited mobility within a wheelchair without requiting any movement on the part of the individual.

It is an additional object of the present invention to provide a wheel chair lift which may be operated by non-technical personnel.

Further objects, features and advantages of the invention will be apparent from the following detailed description when taken in conjunction with the accompanying drawings.

BRIEF DESCRIPTION OF THE DRAWINGS

FIG. 1A is an enlarged fragmentary isometric cross-sectional view of the base of the apparatus of FIG. 1 taken along line 1A.

DESCRIPTION OF THE PREFERRED EMBODIMENT

Figure 1:
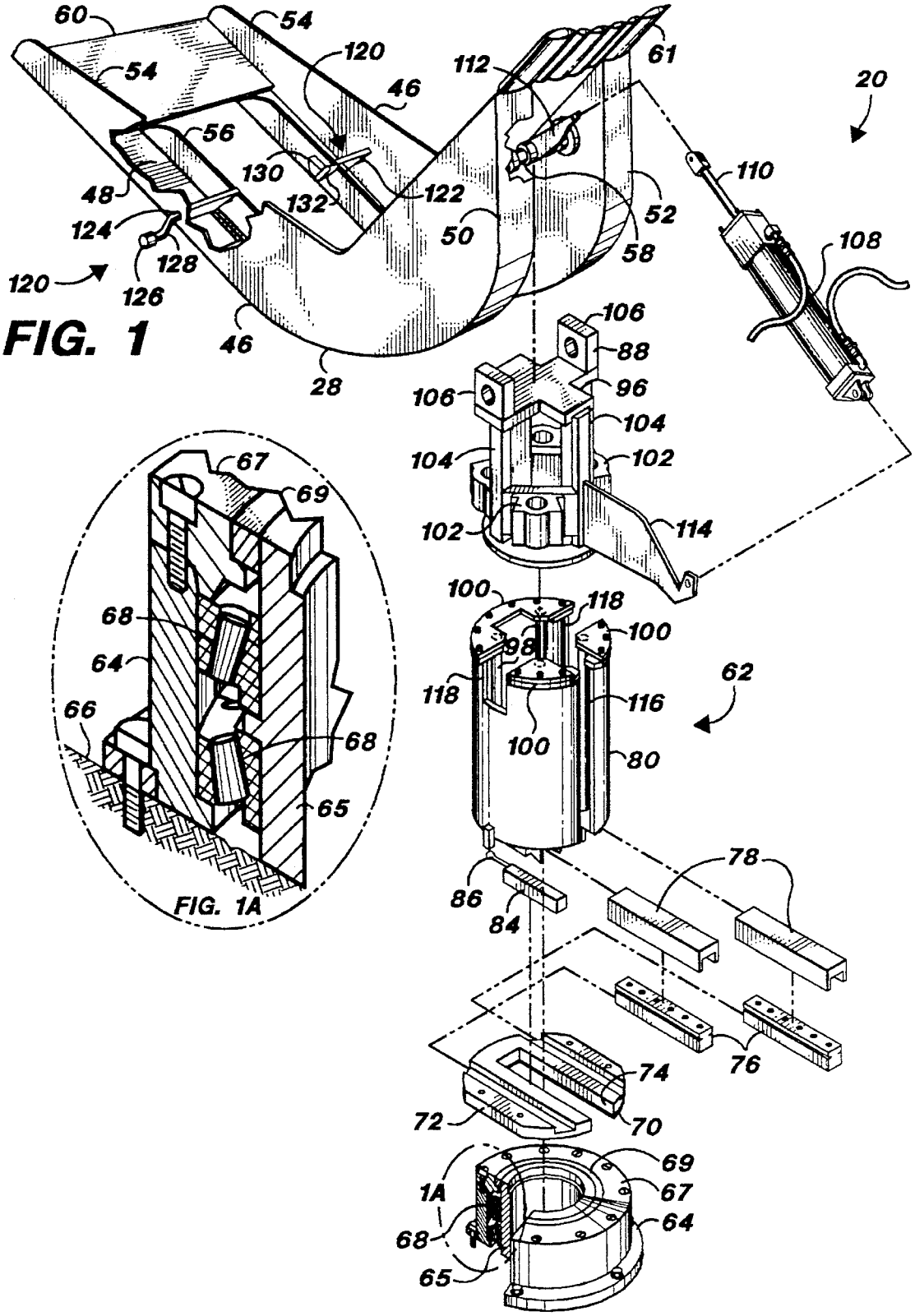
FIG. 1 is an exploded isometric view of the wheelchair tilt lift of this invention.
Figure 2:
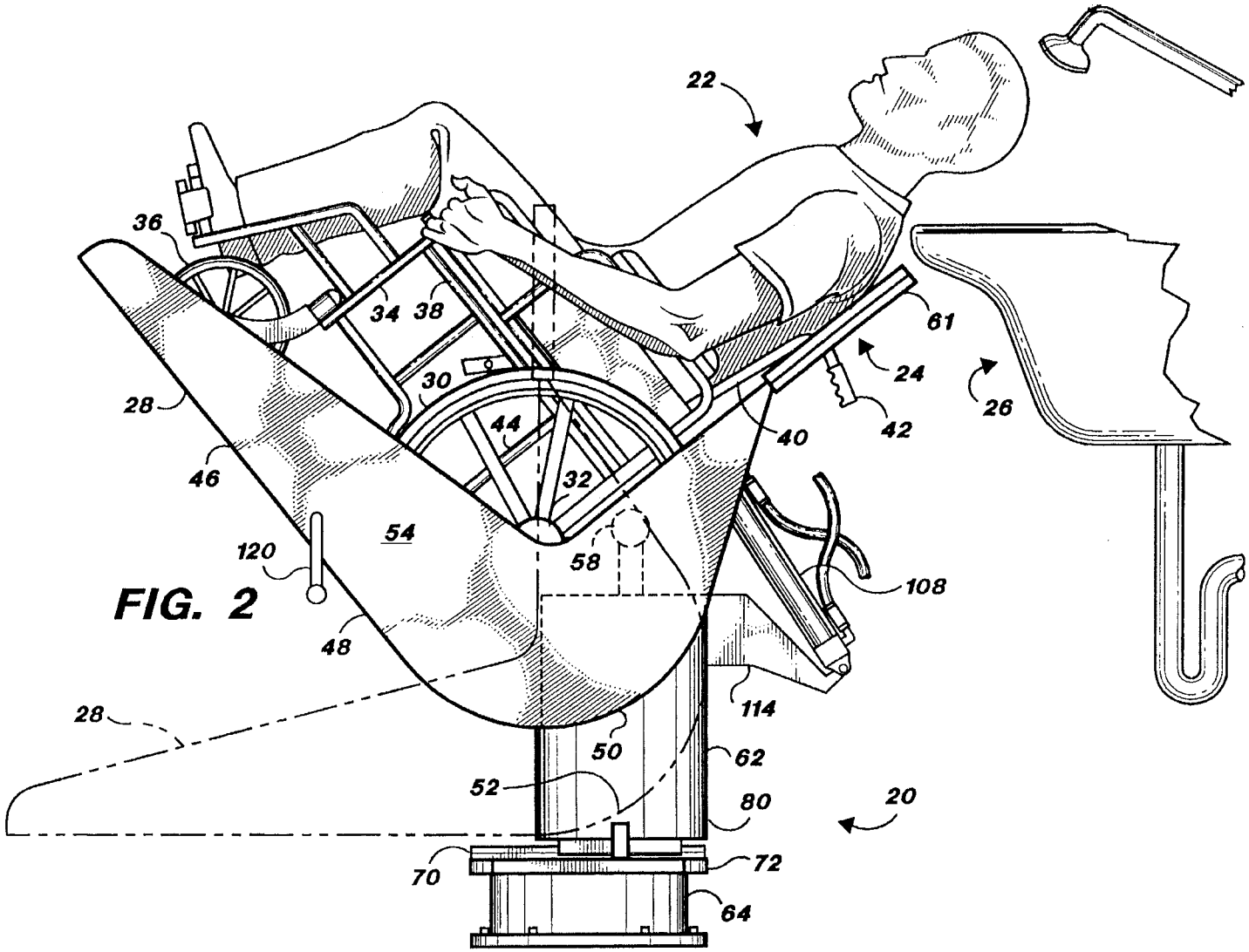
FIG. 2 is a side elevational view of the apparatus of FIG. 1 in a raised, rearwardly displaced, and tilted configuration to position a subject with respect to a sink.

Referring more particularly to FIGS. 1–6, wherein like numbers refer to similar parts, a wheelchair tilt lift 20 is shown in an elevated, tilted, and rearwardly displaced position in FIG. 2. A subject 22 riding a wheelchair 24 is positioned by the lift 20 with respect to a wall mounted hair-dresser's sink 26. The lift 20 has a bucket 28 which is configured to the standard construction of the wheelchair 24 and receives the wheelchair 24 in a space-efficient manner.

Figure 3:
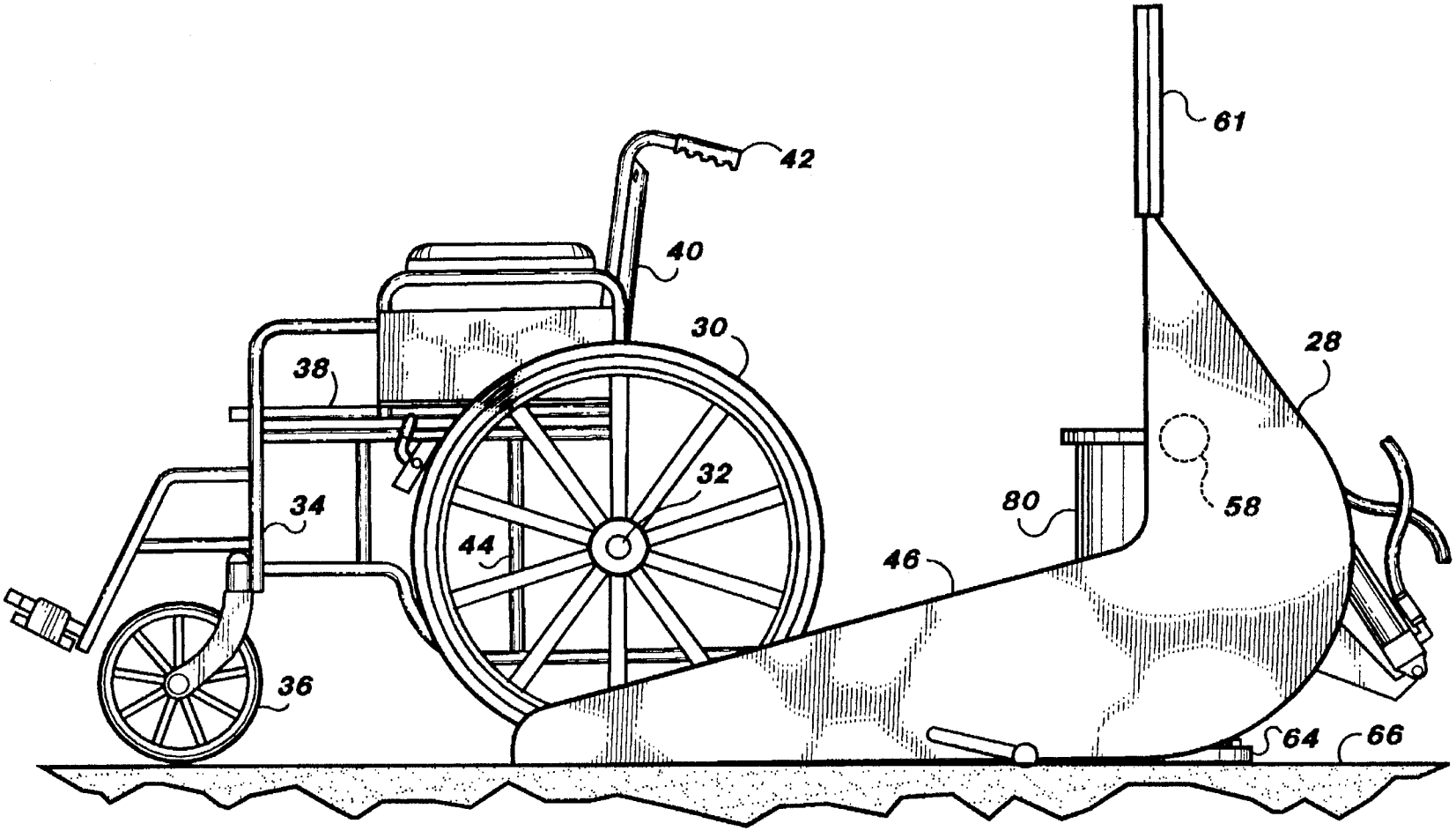
FIG. 3 is a side elevational view of the apparatus of FIG. 2 in a lowered position with a wheelchair shown as it is discharged from the lift bucket.
Figure 5:
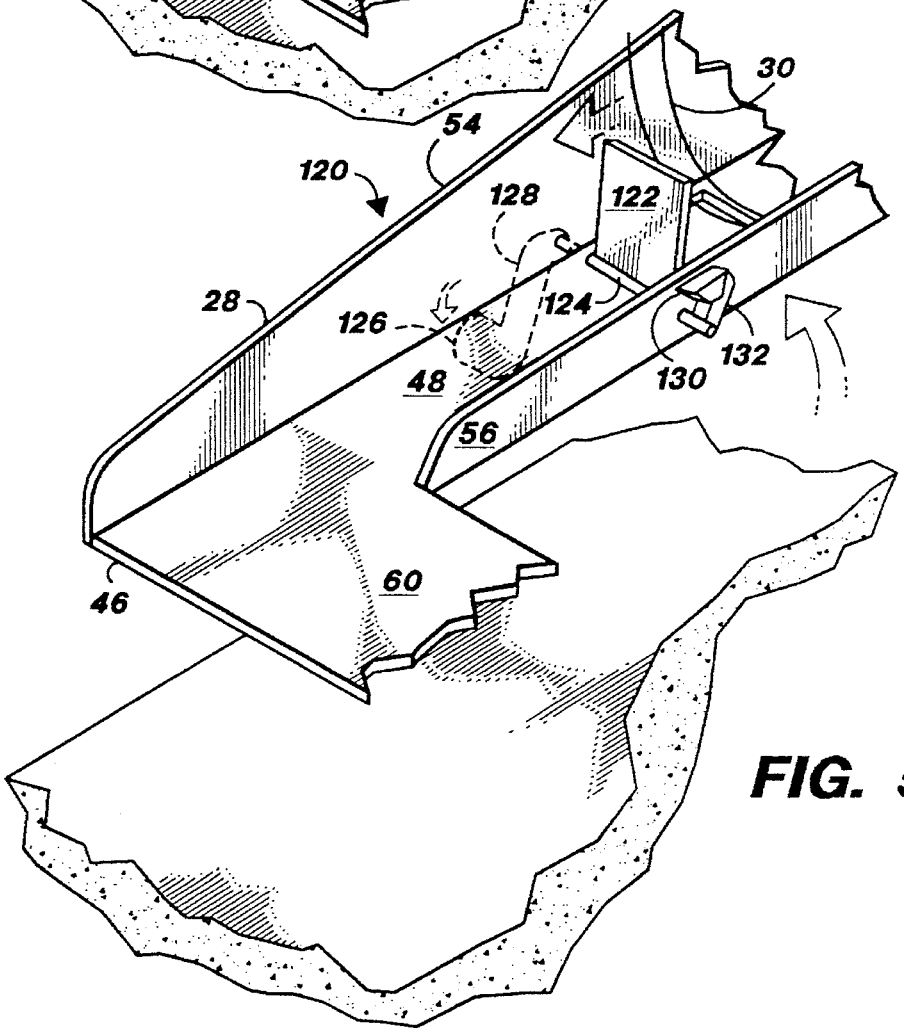
FIG. 5 is a fragmentary isometric view of the tilt lock of FIG. 4 in an engaged position.

Because of the need to interface with facility designs nationwide, most wheelchairs vary only modestly from standard dimensions and construction. The wheelchair 24, best shown in FIGS. 3 and 5, is of conventional design and has two large rear wheels 30 which rotate about independent horizontal axles 32 which are mounted to the tubular steel wheelchair frame 34. The rear wheels 30 are operated by hand and do not pivot. Two pivotable smaller front caster wheels 36 are also mounted to the frame 34. A seat 38 is mounted to the frame above the level of the rear wheel axles 32, but below the tops of the rear wheels 30. A back rest 40 extends upwardly from the seat 38. Two push handles 42 extend rearwardly from the back rest 40 and provide hand holds for push and maneuvering of the wheelchair by a person outside the chair. Most wheelchairs are collapsible to facilitate transport, and have a collapsible reinforcing brace 44 connected to the frame beneath the seat 38, and frontward of the rear wheel axles 32. The position of the brace 44 is not adjustable and limits the accessible volume beneath the wheelchair. The lift 20 is constructed to readily accept standard wheelchairs of this type without interference.

As shown in FIG. 1, the wheelchair lift 20 has a wheelchair bucket 28 which receives the wheelchair and holds it securely for translational, vertical, and tilting motion. The bucket is preferably formed of aluminum or steel plate, although it may also be fabricated of plastic or fiberglass, or any sufficiently strong material. The bucket 28 has two tubs 46 which open upwardly and frontwardly. The tubs 46 are mirror images of one another, and each tub receives a single wheelchair rear wheel 30. Each tub 46 has a planar inlet plate 48 which adjoins a rear plate 50 which is curved and defines a semicylindrical surface 52 which is approximately the same radius as the wheelchair rear wheel. The inlet plate 48 and rear plate 50 are wider than a standard wheel to accommodate variances in wheel spacing. Each tub 46 has an outside lip 54 which extends upwardly from the inlet plate 48 and rear plate 50 and restricts the sideward displacement of the wheelchair 24. The outside lips 54 also stiffen and rigidify each tub 46. An inside lip 56 extends upwardly on the inside of the inlet plate 48 and rear plate 50. The inside lips 56 guide the wheels 30 into position with the bucket 28, and also provide a place of attachment for a rigid axle 58 which extends between and connects the two tubs 46 into a single support structure. To prevent an occupant's feet from extending beneath the inlet plates 48, a toe guard plate 60 extends between the two tubs 46 at the front of the lift. A net or fabric back stop 61 preferably extends between the two tubs 46 above the level of the wheels 30 to engage the back rest 40 of the wheelchair.

It will be noted that the bucket 28 is not significantly larger than the wheelchair 24 and allows unimpeded access to the wheelchair occupant at all times.

The bucket 28 is mounted by the axle 58 to the wheelchair positioning assembly 62 which allows an operator to position a subject vertically, horizontally, angularly, and rotatably about a vertical axis. All these movements are obtained in a structure which is sufficiently compact that access to the subject from either side and from in back is not impeded. The easy access is essential for effective hair dressing and other operations to the subject's head, and provides a convenient operating environment for both right-handed and left-handed operators.

Figure 6:
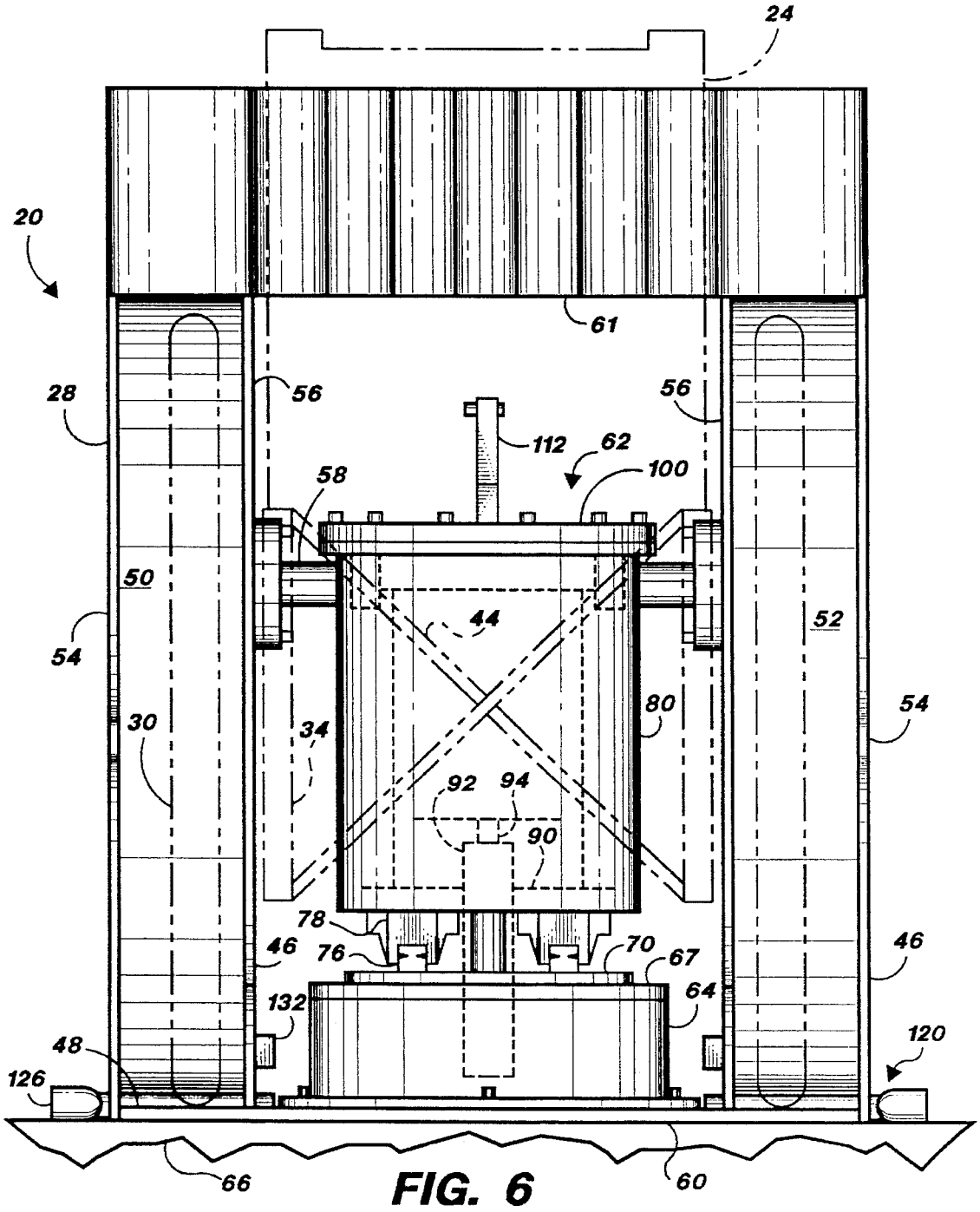
FIG. 6 is a front elevational view of the lift apparatus of FIG. 1.

As shown in FIGS. 1 and 6, the positioning assembly 62 has a pedestal or base 64 which is bolted to a support surface 66, such as a concrete or frame floor. As shown in FIG. 1A, the base 66 has a hub 65 supported on two timken tapered roller bearing 68 for rotational movement about a vertical axis with respect to the base. A cover 67 is bolted to the base 66 to lock the bearings 68 and the hub 65 together to allow 360 degree rotation of the hub. A seal 69 is positioned between the hub 65 and the cover 67 to prevent entry of liquids or debris into the base 64.

A track assembly 70 is mounted to the hub 65 which rotates on the roller beatings 68. The track assembly has a track plate 72 with portions defining a clearance slot 74 for a hydraulic actuator. Two tracks 76 are mounted to the track plate 72. The tracks 76 form, together with sliders 78, linear motion bearings, for the horizontal motion of a housing 80 with respect to the base 64. The linear motion bearings are preferably of the infinite recirculating ball type for maximum smoothness of travel and high load capacity. The sliders 78 are fixed to the housing 80 and open downwardly to slide over the tracks 76.

A horizontal actuator 84 is fixed to the track plate 72. The actuator 84 has an extensible piston 86 which is connected to the housing 80. The actuator 84 is preferably a double acting hydraulic cylinder. An exemplary horizontal travel distance of 6 and a quarter inches is sufficient for positioning a subject's head a sufficient distance within a wall-mounted sink.

The housing 80 is a generally cylindrical shell which encloses a vertical lift frame 88. The housing 80 has a lower plate 90, shown in FIG. 6, to which is mounted a vertical actuator 92. The vertical actuator 92 has an extensible piston 94 which is connected to the cross plate 96 of the lift frame 88. The vertical actuator 92 is preferably a double acting hydraulic cylinder with a vertical travel of approximately nine and a quarter inches. To achieve maximum compactness, the vertical actuator 92 is preferably mounted so that a portion of the actuator descends from the housing 80, through the clearance slot 74 into an opening with the base 64.

Four vertical bearing rods 98 extend upwardly from the housing lower plate 90 and are connected to housing top plate segments 100. The lift frame 88 has four linear motion bearings 102 which extend between four vertical frame members 104. The bearings 102 slide vertically on the bearing rods 98 and provide a comfortable and smooth vertical ride for the bucket 28. The vertical frame members 104 are welded to the lift frame cross plate 96. The cross plate 96 supports two pivot cars 106. The pivot ears preferably include roller beatings located by thrust bearings and set collars. The bucket axle 58 extends through the pivot ears 106 to permit pivoting of the bucket 28 with respect to the frame 88.

The pivoting of the axle 58, and hence the bucket 28, is effected by a tilt actuator 108 which has an extensible piston 110 which is connected to a link 112 which extends radially outwardly from the bucket axle 58. The link 112 is preferably a weldment which is keyed to the axle 58 and provides an extended moment arm for greater tilt. A tilt actuator attachment arm 114 extends horizontally outward from the base of the frame 88 and provides a point for pivotable attachment of the actuator 108. Again, in the service of compactness, the attachment arm 114 extends horizontally to clear the track plate 72 and then extends at an angle, to give greater tilt for a given piston throw. Capability to tilt up to 60 to 90 degrees is desirable.

The housing 80 has a rear vertical slot 116 to provide clearance for the attachment arm 114 as the lift frame is elevated and lowered. Two side slots 118 are also formed in the housing 80 to allow the pivot ears 106 and the bucket axle 58 to be retracted below the level of the housing top plate segments 100.

The controls (not shown) for the hydraulic actuators 84, 92, 108 are preferably mounted on a console for convenient access by the operator. The hydraulic lines for the actuators have been eliminated from the views for clarity. However, in a preferred embodiment the hydraulic lines will pass through the base under the support surface to remove them from sight and avoid clutter.

The positioning assembly 62 and bucket 28 are sufficiently stiff and resistant to shock that a wheelchair 24 supported on the lift 20 is secure from dislodgement by any type of motion of a wheelchair occupant. Nonetheless, to prevent any possibility of the wheelchair 24 escaping from the lift while the lift is still elevated or tilted, a tilt lock assembly 120 is provided on at least one bucket wheel tub 46, and preferably on both.

Figure 4:
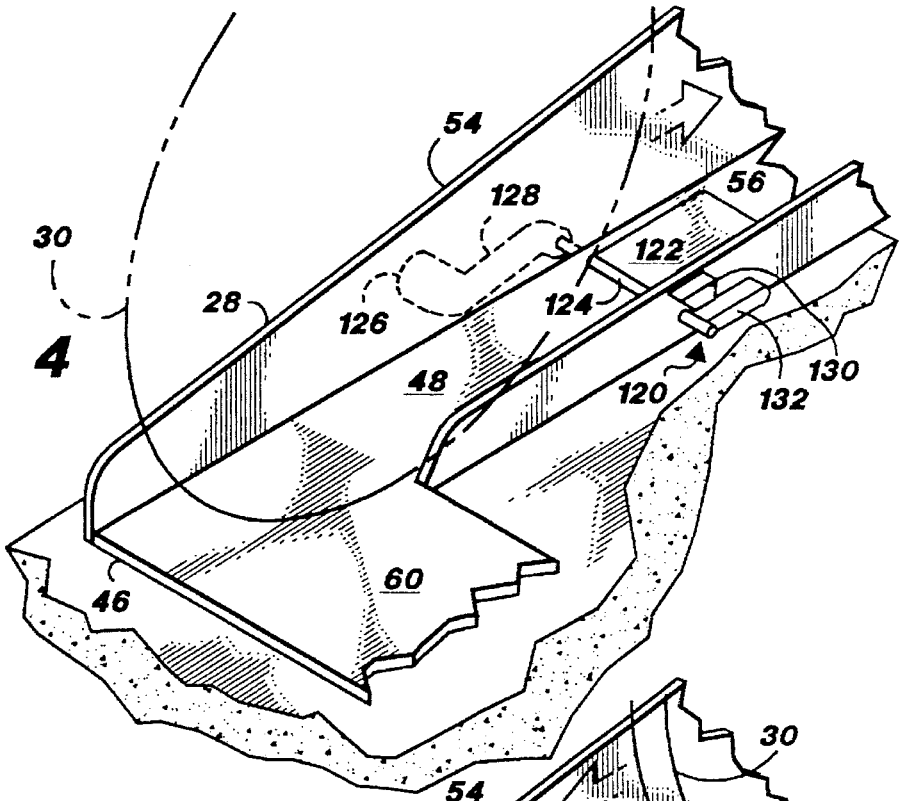
FIG. 4 is a fragmentary isometric view of one wheel-receiving tub of the wheelchair lift bucket of FIG. 1, with a wheel tilt lock shown in unengaged position.

As shown in FIGS. 4 and 5, the tilt lock assemblies 120 provide a passive restraint to escape of the wheelchair 24. The assemblies 120 automatically lock the wheelchair 24 to the bucket 28 whenever the bucket is elevated or tilted without requiting the operator to take any action.

Each lock assembly has a tilt plate 122 which is fit flush within an opening 124 formed in the inlet plate 48 of a tub 46. The tilt plate 122 is mounted rearwardly of a pivot axle 124. A counterweight 126 extends on a crank arm 128 from the pivot axle 124 exterior to the tub 46. The counterweight 126 and crank arm 128 extend frontwardly from the tilt plate 48. As shown in FIG. 4, when the tubs 46 are resting on the support surface 66, the counterweight 126 is pushed into a horizontal position by contact with the support surface 66 and the tilt plate 122 is flush with the inlet plate 48, allowing ingress and egress of the wheelchair into the bucket 28. However, when the inlet plates 48 leave the support surface 66 due to a tilting or elevating of the bucket, the counterweight 126, under the influence of gravity, will pivot the pivot axle 124 to raise the tilt plate 122. Should the wheelchair 24 for any reason begin to tilt forward, it will be engaged against the raised tilt plate 122. Even more, the frontward force of the wheelchair will tend to cause the tilt plate 122 to raise up even higher, further blocking the wheelchair. To prevent the tilt plate 122 from rotating past the vertical, the pivot axle 124 extends on the side opposite the counterweight 126 and has a protruding stop 130 which engages against a stop block 132 when the maximum upturn of the tilt plate has been achieved.

Operation of the tilt lift 20 is illustrated in FIGS. 2 and 3. When the wheelchair occupant is ready for the head care treatment, the wheelchair 24 is wheeled into the bucket 28. As shown in FIG. 1, the pivot axle 58 of the bucket 28 is fixed to the inside lips 56 at a position closely spaced behind the back rest 40. The housing 80, which in the lowered position protrudes frontwardly of the inside tub lips 56, is configured not to interfere with the wheelchair. The tilt actuator 108 engages with the pivot axle link 112 at a position above the axle, with the link extending generally parallel to the wheelchair back rest 40. If appropriate, certain procedures may take place while the subject remains in an untilted unelevated position. When it is desired to begin a procedure which requires tilting of the subject, for example, rinsing the hair in a wall-mounted sink 26, the operator activates the actuators 84, 92, 108 as needed to tilt the bucket 28 and the chair. Once at a proper orientation, it may be necessary to move the subject horizontally to bring the subject's head into position over the sink, the horizontal actuator 84 may be activated as needed. Furthermore, the bucket may be rotated manually on the rotation bearing as required. An exemplary hydraulic system is powered by an electric motor, 110 VAC single phase, and will produce one gallon per minute at 2,000 pounds per square inch. The control valving for the system is conventional.

Because of the compactness of the lift 20, the operator may approach the subject in an elevated position from any direction. Furthermore, without risk of fatigue, the operator may work for an extended period of time, knowing that the subject is secured in place. The tilt locks 120 serve to secure the wheel chair against frontward motion while the bucket is elevated.

It should be noted that the position of the bucket axle 58 with respect to the subject 22 provides for greater comfort and reduced sensations of rapid movement in the subject. To reduce uncomfortable sensations of rapid rotation, it is desirable to minimize centrifugal forces experienced by the subject 22, as well as the speed of travel of a subject's extremities. As both the actual speed of travel of the subjects head and the centrifugal force experienced are a product of the distance between the head and the tilt axis, it will be seen that by positioning the axle 58 approximately beneath the intersection of the wheelchair seat 38 and back rest 40, the distance from the axle to the subject's head and feet is minimized. Thus the elevated axle will induce lower levels of discomfort in a subject than in prior art devices which pivot at a point entirely beneath the wheelchair.

It is understood that the invention is not limited to the particular embodiments disclosed and illustrated herein, but embraces such modified forms thereof as come within the scope of the following claims.

We claim:

1. A wheelchair tilt lift comprising:

a) a base mounted to a support surface, and having a hub which rotates with respect to the base;

b) at least one track mounted to the hub for rotation with respect to the support surface;

c) a housing mounted to the track for transverse motion with respect to the hub;

d) a frame mounted within the housing for vertical motion with respect to the housing;

e) a wheelchair support bucket having two spaced wheel tubs; wherein the support bucket is pivotally mounted to the frame at a position between the two wheel tubs;

f) a first actuator mounted between the bucket and the frame; wherein operation of the first actuator tilts the bucket with respect to the frame;

g) a second actuator connected between the housing and the frame for vertical displacement of the frame; and h) a third actuator extending between the housing and the track for horizontal displacement thereof, wherein the actuators are controllable by an operator to position a person in a wheelchair both horizontally, vertically, and at a desired inclination to position the head of a person in a wheelchair at the proper position for operation thereon.

2. The lift of claim 1 wherein portions of the track define a slot, and the second actuator is mounted to the housing so that portions of the actuator extend through the track slot, thereby compactly positioning the second actuator beneath the frame.

3. The lift of claim 1 further comprising a tilt actuator attachment arm which extends rearwardly from the frame through the housing, and wherein the first actuator is connected between the tilt actuator attachment arm and the bucket.

4. The lift of claim 3 further wherein the bucket tubs are connected by an axle rigidly affected to each tub, and wherein a link extends radially from the axle, and wherein the first actuator is connected between the frame pivot arm and the axle link.

5. The lift of claim 1 further comprising at least one pivotable tilt lock connected to the bucket, wherein the tilt lock extends upwardly to block frontward motion of the wheelchair when the bucket is elevated above the support surface.

6. The lift of claim 1 wherein the each bucket tub has a planar inlet segment joined to a semi-cylindrical rear surface, and at least one tub outer lip extends from the rear surface on the outside of each tub to restrict a wheel chair supported therein from escape from the tubs.

7. The lift of claim 1 wherein the wheelchair bucket has an axis of rotation which is above the level of the base, to thereby minimize discomfort experienced by a person being tilted in the lift.

8. A tilt lift for the positioning of a wheelchair having two wheels mounted about independent axles to each side of a seat, and having a brace positioned frontwardly of said axles beneath said seat, the lift comprising:

a) a base mounted to a support surface;

b) a housing mounted to the base for rotational and transverse motion with respect to the base;

c) a frame mounted within the housing for vertical motion with respect to the housing;

d) two wheel tubs, wherein each tub has a planar inlet segment joined to a semi-cylindrical rear surface which is curved about a horizontal axis, said rear surface defining a means for positioning the wheelchair with respect to the tubs, and said means engaging the wheels of a wheelchair and supporting the wheelchair thereby, and at least one tub outer lip extends from the rear surface on the outside of each tub to restrict a wheelchair supported therein from escape from the tubs; and e) a rod which is fixed to the tubs and extends between the tubs to space the tubs to receive the wheels of a wheelchair therein, wherein the rod defines a rotation axis for the tubs, and wherein the rod is pivotally mounted to the frame for tilting with respect to the frame, and wherein the tub rear semi-cylindrical surface engages against a wheel and remains in contact with a wheel as a wheelchair is tilted, and the tubs position the wheelchair brace frontward of the housing.

9. The lift of claim 8, wherein each wheel tub further comprises a tub inner lip extending upwardly from the rear surface, wherein the rod is fixed between the two inner lips.

10. A tilt lift for the positioning of a wheelchair having two wheels mounted about independent axles to each side of a seat, and having a brace positioned frontwardly of said axles beneath said seat, the lift comprising:

(a) a base mounted to a support surface;

(b) a housing mounted to the base for rotational and transverse motion with respect to the base;

(c) a frame mounted within the housing for vertical motion with respect to the housing;

(d) two wheel tubs, wherein each tub has a planar inlet segment joined to a semi-cylindrical rear surface, and at least one tub outer lip extends from the rear surface on the outside of each tub to restrict a wheelchair supported therein from escape from the tubs; and (e) a rod which is fixed to the tubs and extends between the tubs to space the tubs to receive the wheels of a wheelchair therein, wherein the rod defines a rotation axis for the tubs, and wherein the rod is pivotally mounted to the frame for, tilting with respect to the frame, and wherein the tub rear semi-cylindrical surface engages against a wheel and remains in contact with a wheel as a wheelchair is tilted, and the tubs position the wheelchair brace frontward of the housing;

(f) at least one pivotable tilt lock connected to a tub, wherein the tilt lock extends upwardly to block frontward motion of the wheelchair when the tubs are elevated above the support surface.

11. The lift of claim 8 wherein the housing extends beneath the rod, and wherein the housing has portions defining upwardly opening slots, such that the rod may be retracted to a level beneath the top of the housing.

12. The lift of claim 8 wherein the rod defines an axis of rotation which is positioned immediately beneath the seat of a wheelchair received within the bucket, the positioning of the axis of rotation serving to minimize discomfort experienced by a subject tilted in the lift.

13. The lift of claim 9 wherein the housing has a plurality of vertically extending bearing rods, and wherein the frame has a plurality of linear motion bearings which engage with the bearing rods for sliding vertical engagement thereon.

14. The lift of claim 9 further comprising a foot plate which extends between the two tub inlet plates to keep a person's feet from coming under the inlet plates.

15. A wheelchair safety tilt lift comprising:

a) a base for mounting to a support surface;

b) a wheelchair bucket having two spaced wheel-receiving tubs, wherein the bucket is mounted to the base for vertical, horizontal, and tilting displacement with respect to the base, and wherein each tub has a planar inlet plate over which a wheel of a wheelchair travels on entry into the bucket, and each tub has a rear surface which is curved about a horizontal axis, said rear surface defining a means for positioning the wheelchair with respect to the tubs, and said means engaging the wheels of a wheelchair and supporting the wheelchair thereby;

c) portions of the planar inlet plate which define a downwardly-opening hole;

d) a tilt plate pivotally mounted about an axle to the inlet plate, wherein the tilt plate is pivotable between a lower position in which the plate is parallel to the inlet plate, and a tilted position in which the tilt plate extends upwardly from the inlet plate to prevent the escape of a wheel received within the tub; and e) a counterweight connected to the tilt plate axle for engagement with the support surface when the bucket is in a lowered untilted position, such that elevation or tilting of the bucket causes the counterweight to pivot the tilt plate axle to thereby raise the tilt plate to the tilted position and to thus prevent the escape of a wheelchair from the lift when the bucket is elevated or tilted, but to permit egress from the bucket when the bucket is in the lowered untilted position.

* * * * *